US006446811B1

(12) United States Patent
Wilfong, Jr.

(10) Patent No.: US 6,446,811 B1
(45) Date of Patent: Sep. 10, 2002

(54) SELF-OPENING SERIALLY-ARRANGED PLASTIC BAG PACK OF THE STAR-SEAL TYPE

(75) Inventor: Harry B. Wilfong, Jr., Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/749,057

(22) Filed: Dec. 27, 2000

(51) Int. Cl.[7] ..... B65D 33/14
(52) U.S. Cl. ..... 206/554; 383/9
(58) Field of Search ..... 206/554; 383/8, 383/9, 37

(56) References Cited

U.S. PATENT DOCUMENTS

| | | | | |
|---|---|---|---|---|
| 2,195,098 | A | | 3/1940 | Skellet |
| 3,285,406 | A | | 11/1966 | Winesett |
| 3,349,991 | A | | 10/1967 | Kessler |
| 4,349,123 | A | | 9/1982 | Yang |
| 4,406,371 | A | | 9/1983 | Membrino |
| 4,557,384 | A | | 12/1985 | Membrino |
| 4,759,639 | A | | 7/1988 | DeMatteis |
| 4,759,742 | A | | 7/1988 | Achelpohl |
| 4,769,125 | A | | 9/1988 | Roen et al. |
| 4,769,126 | A | | 9/1988 | Roen et al. |
| 4,785,938 | A | | 11/1988 | Benoit, Jr. et al. |
| 4,790,437 | A | | 12/1988 | Pistner |
| 4,854,451 | A | | 8/1989 | Jensen |
| 5,192,133 | A | | 3/1993 | Juel et al. |
| 5,207,328 | A | | 5/1993 | Bose et al. |
| 5,209,573 | A | | 5/1993 | Freeman |
| 5,248,040 | A | | 9/1993 | DeMatteis et al. |
| 5,307,935 | A | | 5/1994 | Kemanjian |
| 5,335,788 | A | | 8/1994 | Beasley et al. |
| 5,346,310 | A | | 9/1994 | Nguyen |
| 5,467,572 | A | | 11/1995 | Wile et al. |
| 5,469,969 | A | | 11/1995 | Huang |
| 5,497,884 | A | | 3/1996 | DeMatteis et al. |
| 5,561,967 | A | | 10/1996 | Nguyen |
| 5,562,580 | A | * | 10/1996 | Beasley et al. ..... 493/194 |
| 5,590,784 | A | | 1/1997 | Daniels |
| 5,662,225 | A | | 9/1997 | DeMatteis |
| 5,690,228 | A | | 11/1997 | DeMatteis |
| 5,695,064 | A | | 12/1997 | Huang et al. |
| 5,845,779 | A | * | 12/1998 | Wilfong Jr. et al. ..... 206/554 |
| 5,881,882 | A | * | 3/1999 | Fletcher et al. ..... 206/554 |
| 5,941,393 | A | | 8/1999 | Wilfong, Jr. |

* cited by examiner

*Primary Examiner*—Bryon P. Gehman
(74) *Attorney, Agent, or Firm*—Alston & Bird LLP

(57) ABSTRACT

A pack of self-opening serially-arranged plastic bags of the "star-seal" type defining eight superimposed wall layers in the bag. Mounting tabs form a part of top portions of each of the eight layers and are positioned in superimposed positions and each includes an aperture for mounting the tabs on a tab retaining device of a rack in a non-front-side-free manner. Each of the tabs includes a mechanism for rendering the tab detachable and providing a predetermined detaching strength. In one embodiment, each of the tabs are detachable from the rack and in another embodiment, each of the tabs are detachable from the bag. A frangible bond is formed between the rear layer and the front layer of each successive bag in the pack. This frangible bond has a predetermined strength (1) which is greater than the predetermined detaching strength of two of the tabs and (2) is weaker than the predetermined detaching strength of the remaining six tabs to allow the leading bag of the pack (when pulled by a user for removal) to disengage from the pack, while (before disengagement) pulling the succeeding bag in the pack to cause detaching of the two leading of the tabs for self-opening of the succeeding bag.

15 Claims, 4 Drawing Sheets

14
11
13

14
11
15
15
13

13
15
14
15
A
11
15
15
13
14

10
15
25
13
25
D 21
25
25
11
11
11
21
25
10
13
15
D 15
14
25
11
13
11
11
13
25
25
16
15
21
D
25
25

11
11
11
10

SELF-OPENING SERIALLY-ARRANGED PLASTIC BAG PACK OF THE STAR-SEAL TYPE

FIELD OF THE INVENTION

This invention relates to a pack of self-opening serially-arranged plastic bags of the "star-seal" type particularly suited for use in packaging grocery produce and adapted to be suspended in desired lengths from a rack for being serially opened and removed from the rack.

BACKGROUND OF THE INVENTION

Plastic bags have been replacing paper bags in the United States since the 1970s (and elsewhere more recently) in the grocery and retail products industries due to the superior and inherent moisture resistant properties and strength of plastic. In these industries, these plastic bags have usually included integrally connected front and rear wall portions and, sometimes, gussetted side wall portions, all secured together at the bottoms thereof by a seal to define a closed bottom on the bag. The bag walls are open at the top to define a mouth portion on the bag. Some of these bags are of the "T-shirt" type which provides spaced integral handles laterally extending upwardly from opposed sides of the open mouth of the bag at the top to provide ease in carrying of the bag by the consumer. However, these plastic bags have also included handless generally flat top rectangular shape bags, similar to the prior paper bags, without upwardly extending handles. These plastic bags have been provided to and used by the grocery and retail product industries in the form of packs of a plurality of superimposed bags connected together and adapted to be serially opened and removed from the rack, or in the form of a roll of plastic bags connected end-to-end and mounted on a rack to be serially removed and opened up, for packaging of the grocery or retail products.

The produce bag market in the United States grocery industry has been dominated over the years by plastic bags on a roll. These bags are typically manufactured of LDPE or HMW-HDPE in gauges from 0.50 to 0.35 mil. The biggest complaint with this style bag by shoppers is the difficulty in getting the bag opened. Grocery produce bags have been introduced of the HMW-HDPE construction which utilize a "star seal" to close the bottom of the bag. The "star seal" design (well known in the industry as a bag having multiple layers and longitudinally folded over on itself and sealed at the bottom so that when it is opened up, the bottom of the bag viewing from the inside resembles a star) got its start in the HMW-HDPE can liner market because of the excellent bottom seal strength it offers with thin gauge films.

Grocery produce bags of this star seal type have been accepted in part because of their strength, but also because they are somewhat easier to open than the traditional roll produce bags. Openability of this star seal type bag is improved due to the increased number of layers of film at the bag mouth. Notwithstanding, the shopper still mistakes the bottom of the bag for the top of the bag leading to frustration in opening of the bag. For the most part, these star seal type plastic produce bags have been provided in the roll form, although some bag packs of superimposed star seal type bags have been proposed. However, to applicant's knowledge, all of the original bag packs of star seal type bags have been connected at the bottoms of the bags and suspended from a rack bottom-side-up so that the user must first remove the bag from the bag pack and then open the bag prior to loading of produce therein. This arrangement has presented additional problems with opening of the individual bags and does not provide for serially opening or self-opening of the bags as they are removed from the bag pack and from the rack.

More recently, the assignee of the present application has introduced a pack of star-seal type easy-opening handless or T-shirt type plastic bags for packaging grocery produce or the like and which is adapted to be suspended from the top of the bags of the pack by detachable tabs extending upwardly from each layer of the bag for mounting the bag pack on a rack. For easy-opening of these bags, at least the front two tabs of the eight superimposed tabs of each star-seal type bag in the pack include means for rendering these front two wall layers of each bag front-side-free. This construction allowed a user to grasp these front two layers of each eight-layer folded star-seal type bag and pull it forward to remove it from the rack. This bag pack construction is fully disclosed in assignee's U.S. Pat. No. 5,941,393, the disclosure of which is incorporated herein by reference.

While the bag construction of this U.S. patent of assignee had been widely accepted by consumers, it has presented a number of problems with respect to manufacture thereof. The difficulty in manufacturing a bag pack of the type described in this patent involves the manufacture of the front-side-free feature. To produce the front-side-free feature, a cutting process must be utilized which requires (1) the separation of individual plies of the bag by some means so that the front two plies only can be cut, (2) transport of the bag and (3) collection of individual bags into a pack. Each of these steps adds complexity to the manufacturing process and causes additional expense in producing the bag packs.

OBJECT AND SUMMARY OF THE INVENTION

Accordingly, it is an object of this invention to provide a pack of serially-arranged plastic bags of the star-seal type which overcomes the problems discussed above.

In accordance with this invention, it has been found that a pack of serially-arranged superimposed plastic bags of the star-seal type can be produced which are not front-side-free (providing easy opening of the bags), but which are self-opening by virtue of the following novel construction.

Each of the bags of the pack comprises integrally formed front and rear walls and gussetted side walls extending inwardly toward each other to terminate in close proximity to each other. These walls have top portions defining an open mouth. The front and rear walls and gussetted side walls are further folded-over onto each other along a longitudinal axis of the bag to define eight superimposed wall layers in the bag which includes a front layer, a rear layer and six intermediate layers. A seal of the "star-seal" type secures the bottoms of the eight superimposed wall layers together to close the bottom of the bag.

Mounting tabs form a part of the top portions of each of the eight wall layers of each bag and are in superimposed positions. Each mounting tab includes an aperture for mounting the tabs on a tab retaining device of a rack in a non-front-side-free manner. Each of the tabs includes means rendering the tab detachable and providing a predetermined detaching strength.

In one embodiment of the invention, the mounting tabs are detachable from the tab retaining device of the rack and provide a predetermined detaching strength to prevent premature tearing of the tab. This is accomplished by providing a means for propagating a tear from the tab mounting aperture to the top of the tab and which is preferably in the form of a V-shaped cut-out in the top of the tab over the tab mounting aperture and a nick formed in the tab and extending from the V-shaped cut-out toward the tab mounting aperture.

In another embodiment of this invention, the mounting tabs extend upwardly from the top portion of each of the eight wall layers of each bag and are detachable from the bags remaining on the tab retaining device of the rack and preferably include a neck portion which is narrower than the remaining portion of the tab and connects the tab to the respective bag wall layer. A means for propagating a tear across the tab preferably comprises a slit extending across a portion of the dimension of the neck portion of the tab and allows the tearing off of the tab from the bag while retaining sufficient strength in the tab to prevent premature tearing off of the tab and to provide a predetermined detaching strength for the tab.

The bag pack of this invention further includes a frangible bond between the rear layer and the front layer of each successive bag in the pack. This frangible bond has a predetermined strength which is (1) greater than the predetermined detaching strength of two of the tabs and (2) weaker than the detaching strength of the remaining six tabs of each bag, to allow the leading bag of the pack (when pulled by a user for removal) to disengage from the pack, while (before disengagement) pulling the succeeding bag in the pack to cause detaching of the two leading tabs for self-opening of the succeeding bag. This frangible bond preferably comprises a corona treatment on the front and rear layers of each of the folded bags and at least one (preferably a plurality) localized compressed area extending transversely through the bag pack in the top portions of the bag such that the bag pack has a decreased thickness in the compressed area and wherein the adjacent corona treated front and rear layers of successive bags in the compressed area are adhered together by a corona-induced pressure bond and adjacent intermediate layers in the compressed area are not appreciably adhered together.

The bag pack preferably includes means for aiding in maintaining the bags in the pack in substantial registration in the form of one or more cold weld areas piercing and extending transversely through said bag pack or in the form of a heat seal compression bond area through the superimposed mounting tabs.

BRIEF DESCRIPTION OF THE DRAWINGS

Some of the objects and advantages of this invention have been set forth above and other objects and advantages will appear in the Detailed Description Of Preferred Embodiments Of The Invention to follow, when taken in conjunction with the accompanying drawings, in which.

DETAILED DESCRIPTION OF THE PREFERRED EMBODIMENTS OF THE INVENTION

Figure 10:
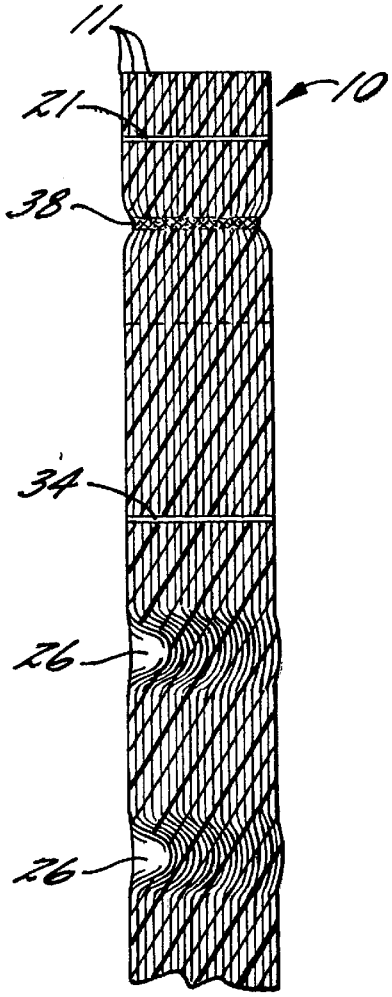
FIG. 10 is a partial sectional view through the bag pack of FIG. 9 and taken generally along the line 10—10 of FIG. 9.
Figure 11:
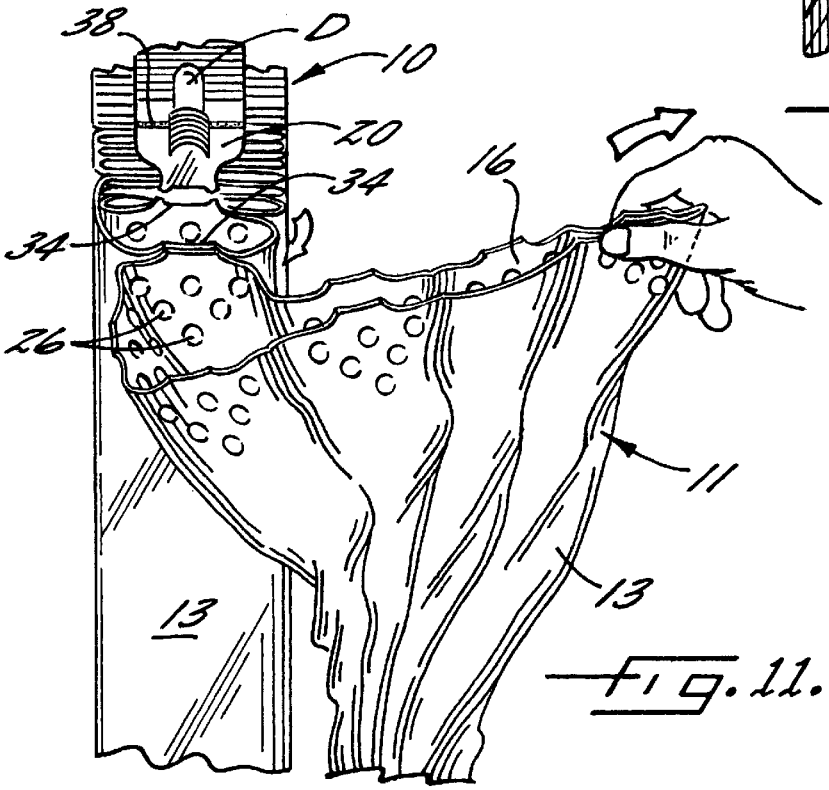
FIG. 11 is a schematic perspective view of the bag pack of FIG. 9 mounted on a tab retaining device of a rack and showing the removal and opening-up of successive bags from the rack.

In the following detailed description of this invention, various embodiments are described in order to provide a full and complete understanding of the invention and its preferred embodiments. It will be recognized that although specific terms are employed to describe specific structural elements, these terms are employed in the descriptive sense and these structural elements are susceptible to numerous and various alternatives, modifications and equivalents as will be apparent to the skilled artesian. Referring now to the drawings, a first embodiment of this invention is illustrated in FIGS. 1–8 and a second embodiment of this invention is illustrated in FIGS. 9–11.

Both embodiments of the invention include a pack 10 of superimposed self-opening serially-arranged plastic bags 11 adapted for being suspended in different lengths from a tab retaining device D of a rack R (see FIG. 3) for being serially-opened and removed from the rack (see FIGS. 7(A)–(C) and 8(A)–(D)) for packaging grocery produce or the like.

Figures 4, 5, 6, 7A, 7B, 7C:
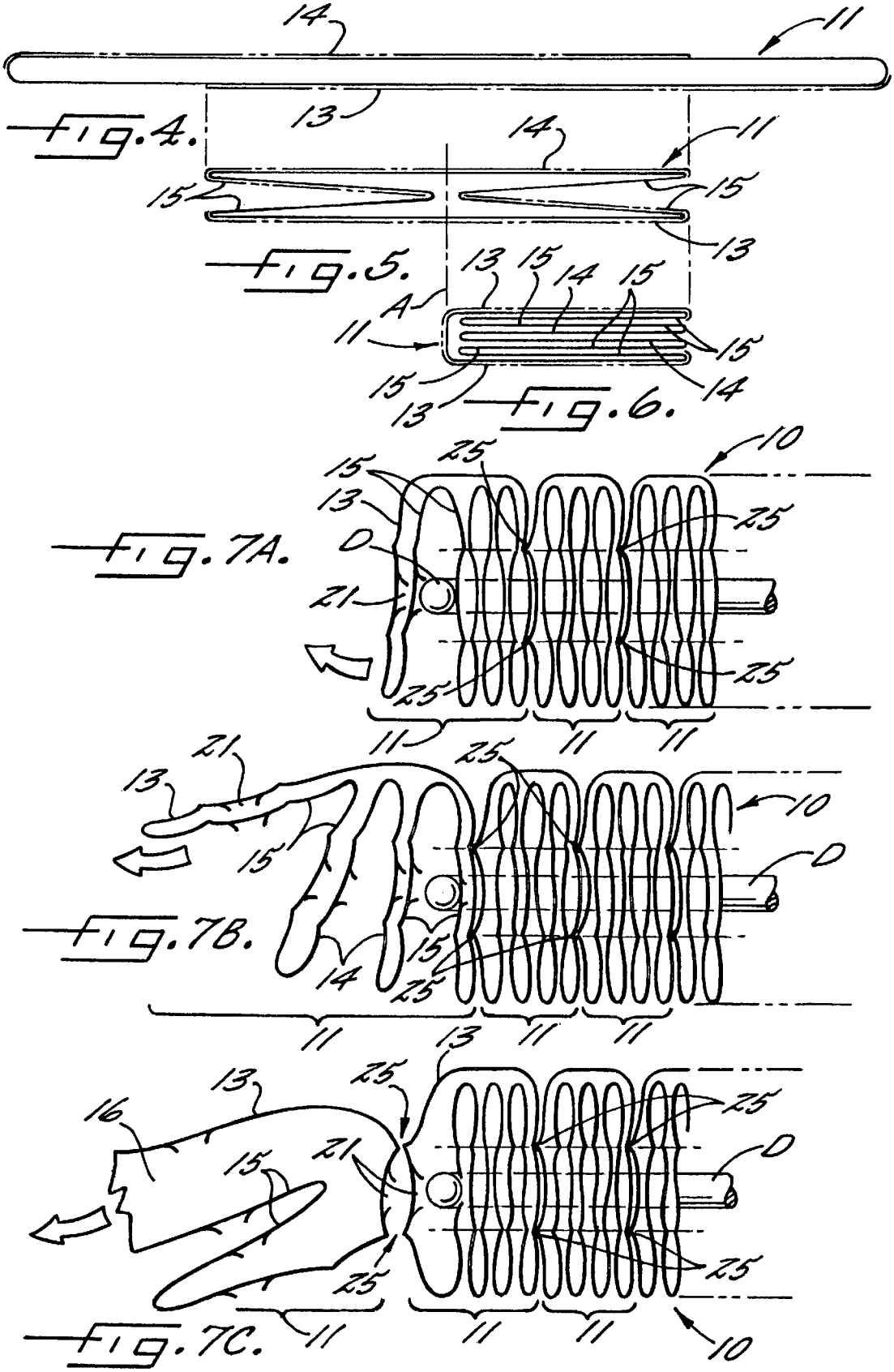
FIGS. 4, 5 and 6 are schematic and diagrammatic sectional views through a bag utilized in the bag pack of FIG. 1 and showing the stages of folding of the bag to first form gussets and then the folding of the gussetted bag over onto itself to form an eight wall layered bag which may be star-sealed at the bottom thereof.
FIGS. 7(A), (B) and (C) are schematic sectional views through three bags of the pack of FIG. 1 and mounted on a tab retaining device of a rack and illustrating the removal of the first bag from the rack and the opening-up of the front two layers of the second succeeding bag on the rack.
Figure 8A:
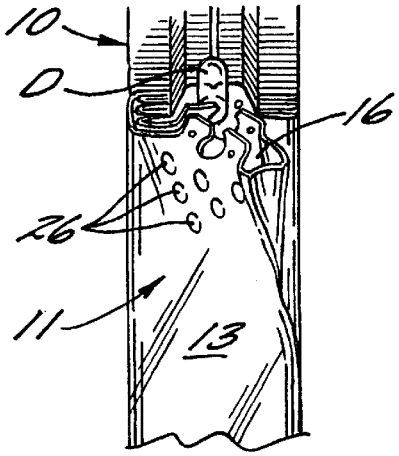
FIGS. 8(A)–8(D) are schematic perspective views illustrating the opening-up and removal from a rack of a bag from a pack of the type illustrated in FIG. 1.
Figure 8B:
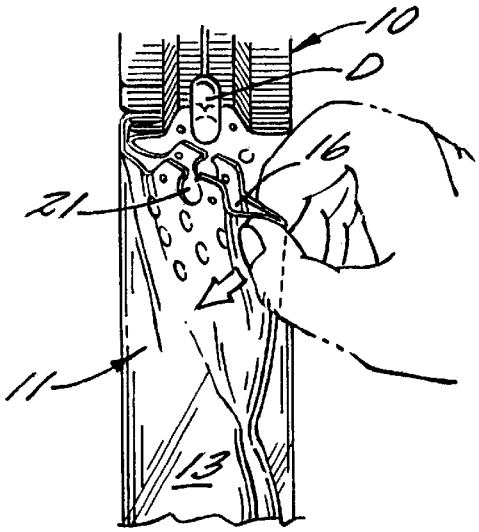
Figure 8C:
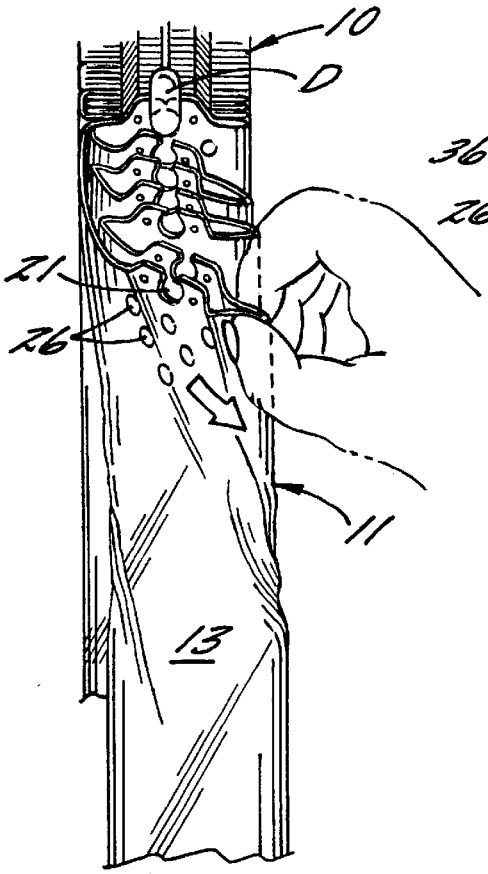
Figure 8D:
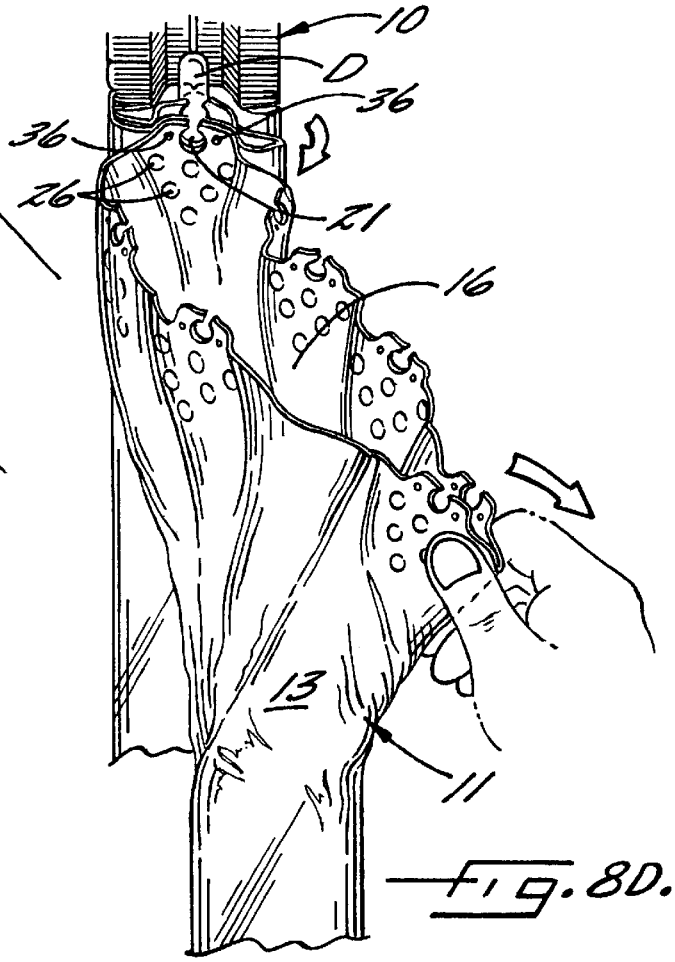

Each of the bags 11 comprises (see FIGS. 4 and 5) integrally formed front and rear walls 13, 14 which are first gussetted to form side walls 15 which extend inwardly toward each other to terminate in close proximity to each other. All of the walls 13, 14 and 15 have top portions defining an open mouth 16 for the bag 11 (see FIGS. 8(D) and 11). The front and rear walls 13, 14 and the gussetted side walls 15 are further folded over onto each other along a longitudinal axis A of the bag 11 to define eight superimposed wall layers 13, 14 and 15 in the bag 11 (as shown in FIG. 6). A seal 18 of the "star-seal" type secures the bottoms of the eight superimposed layers 13, 14 and 15 together to close the bottom of the bag 11. As discussed above and as illustrated in assignee's aforementioned U.S. Pat. 5,941,393, a "star-seal" is well known in the industry as a seal for securing the bottom of multiple layers of a bag so that when the bag is opened-up and viewed from the inside thereof the inside resembles a star (as illustrated in the aforementioned '393 U.S. Patent).

Figure 1:
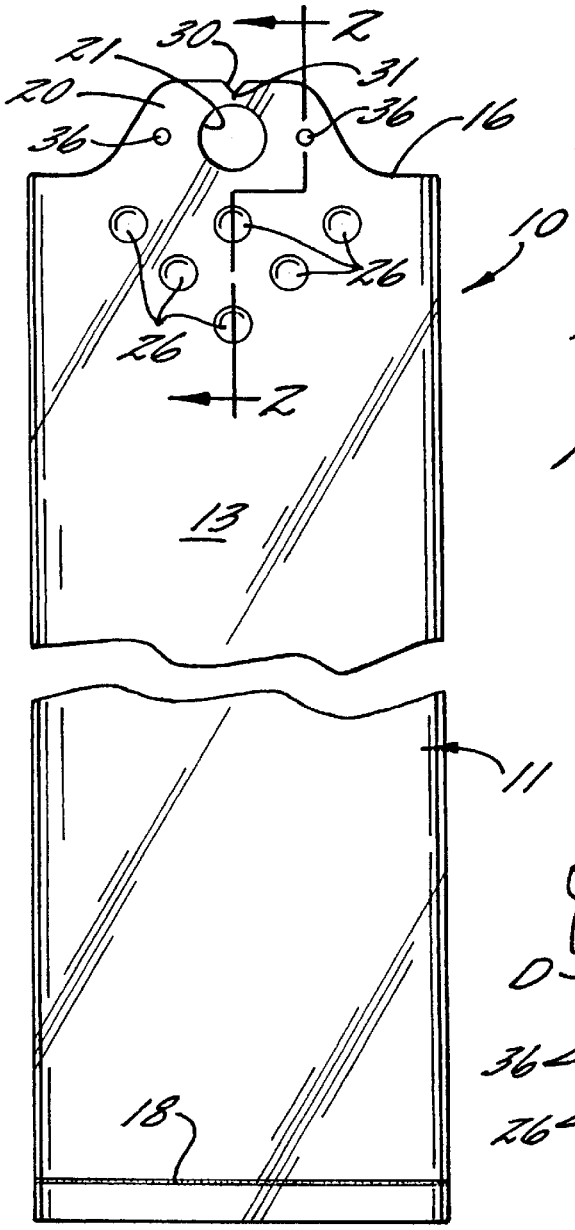
FIG. 1 is an elevational view, broken away, of a pack of self-opening serially-arranged plastic bags of the handleless type and constructed in accordance with this invention and having a first form of mounting tabs thereon.
Figure 2:
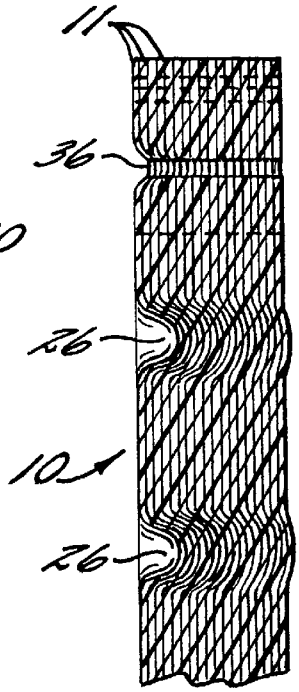
FIG. 2 is a sectional view through the bag pack of FIG. 1 and taken generally along the line 2—2 of FIG. 1.
Figure 3:
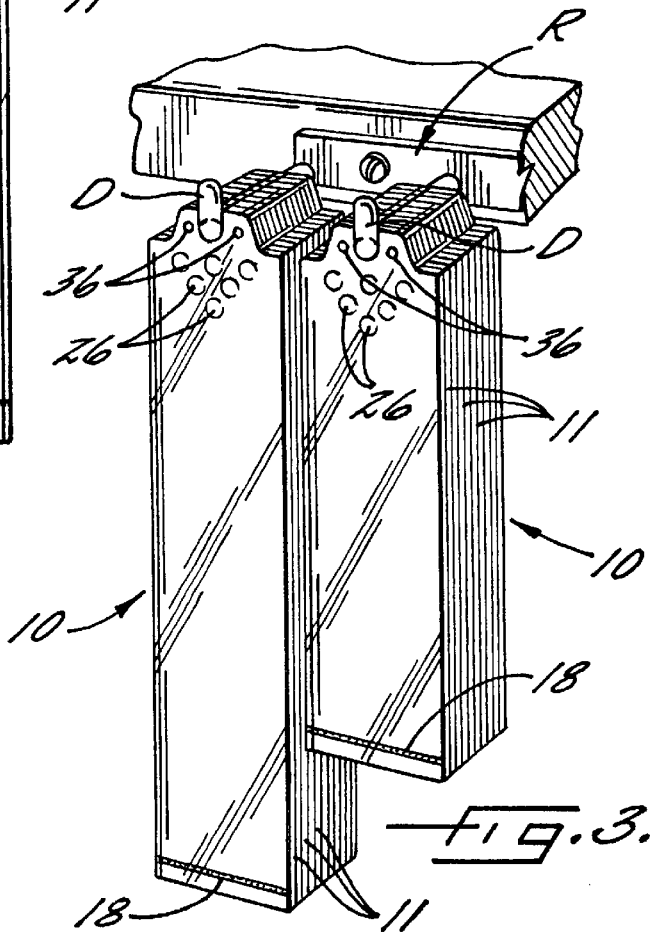
FIG. 3 is a perspective view of two packs of handleless bags of the type illustrated in FIG. 1 and of different lengths and mounted on tab retaining devices of a rack.
Figure 9:
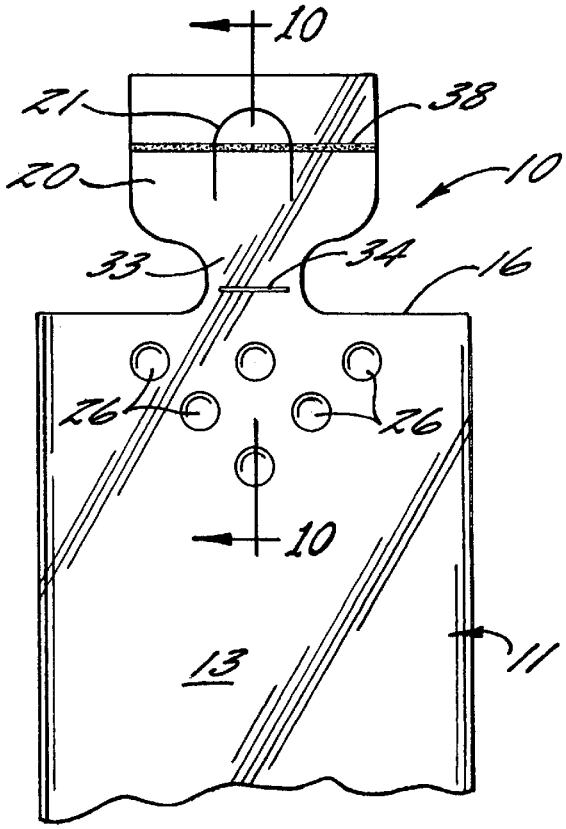
FIG. 9 is a partial elevational view of a pack of self-opening serially-arranged plastic bags of the handleless type and constructed in accordance with this invention and having a second form of mounting tab thereon.

Both embodiments of the invention further include detachable tabs 20 extending upwardly from each of the eight wall layers 13, 14, 15 at the top portions thereof and in the area of the open mouth 16 of the bag 11 (see FIGS. 1 and 9). These detachable tabs 20 are in superimposed position and each includes an aperture 21 for mounting the tabs 20 on a tab retaining device D of a bag rack R in a non-front-side-free manner (see FIGS. 3 and 11). By contrast the front two wall layers of the star-seal bag of assignee's aforementioned '393 U.S. patent were mounted on a rack in a front-side-free manner. Each of the mounting tabs 20 include means (to be discussed in more detail below) rendering the tab 20 detachable and providing a predetermined detaching strength. While in both illustrated embodiments of the invention, the detachable tabs 20 extend upwardly from each of the eight wall layers 13, 14, 15 at the top portions thereof, these tabs 20 (for the embodiment of FIG. 1–8) could be formed below the tops of these top portions so that each of the eight layers 13, 14, 15 has a flat top.

The aperture 21 in the mounting tabs 20 may take various desired shapes depending upon the type of tab retaining device D utilized on the rack R. For example, if a tab retaining device D of the well known inverted U-shaped wire loop type (commonly referred to in the industry as a "D-ring" tab retaining device) is utilized, the tab mounting aperture 21 may be in the shape of a slit extending across the bag mounting aperture or the tab mounting aperture may be of a generally spade-shaped cut. When utilizing a tab retaining device D on the rack R of a generally single post hook shape (as illustrated in the drawings herein), a circular tab-mounting aperture 21 may be utilized. This generally circular tab mounting aperture 21 (as illustrated in the embodiment of FIGS. 1–8) is preferably a clear-cut hole without any flap portions for ease in loading of a relatively thick pack 10 of bags 11 onto the tab retaining device D of bag rack R. However, the aperture 21 may also be of a generally inverted U-shape with a flap portion (as illustrated in the embodiment of FIGS. 9–11). Any desired shaped aperture may be utilized with either of the embodiments illustrated herein or other embodiments contemplated by this invention.

Both embodiments of the invention further include a frangible bond 25 (see FIGS. 7(A)–(C) between the rear layer and the front layer of each successive bag 11 and the pack 10. The frangible bond 25 has a predetermined strength (1) which is greater than the predetermined detaching strength of two of the tabs 20 and (2) which is weaker than the predetermined detaching strength of the remaining six tabs 20 to allow the leading bag 11 of the pack 10 (when pulled by a user for removal) to disengage from the pack and, while (before disengagement) pulling the succeeding bag 11 in the pack 10 to cause detaching of the two leading tabs 20 or self-opening of the succeeding bag 11.

In both embodiments of this invention, the frangible bond 25 between successive bags 11 in the pack 10 comprises (as fully explained in assignee's prior U.S. Pat. No. 5,335,788, the disclosure of which is incorporated herein by reference) a corona treatment on the front and rear layers 13 of each of the eight layer folded bags 11, and at least one localized compressed area 26 extending transversely through the bag pack 10 in the top portions of the bags 11 such that the pack 10 has a decreased thickness in the compression area 26 (see FIGS. 2 and 10). It is preferable to provide a plurality of such compressed areas 26 which are equally spaced from each other in the top portions of the walls 13, 14, 15 of the bags 11 and the pack 10. With this construction, adjacent corona treated front and rear layers 13 of successive bags 11 in the pack 10 at the compressed areas 26 are adhered together by a corona-induced pressure bond and adjacent intermediate layers 14, 15 in the compressed areas 26 are not appreciably adhered together, as fully explained and discussed in assignee's aforementioned prior '788 U.S. patent.

This frangible bond 25 could also be formed as a glue or adhesive bond or other desired bond as long as the above relationship of strength between the frangible bond 35 and the detachable tabs 20 of the bag is maintained.

In the embodiment of FIGS. 1–8, the tabs 20 are detachable from the tab retaining device D of the rack R and remain with the bag 11. The means for rendering each of the tabs 20 detachable and providing a predetermined detaching strength comprises means for propagating a tear from the tab mounting aperture 21 to the top of the tab for detaching the tab 20 from the tab retaining device D of the rack R while retaining sufficient strength in the portion of the tab 20 above the tab mounting aperture 21 to prevent premature tearing of the tab 20. This means for propagating a tear from the tab mounting aperture 21 to the top of the tab 20 comprises a V-shape cut-out 30 in the top of the tab 20 over the tab mounting aperture 21 and a nick 31 formed in the tab 20 and extending from the V-shaped cut-out 30 toward the tab mounting aperture 21.

In the embodiment of FIGS. 9–11, the tabs 20 are detachable from the bags 11 and remain on the tab retaining device D of the rack R. The means for rendering each of the tabs detachable and providing a predetermined detaching strength comprises means positioned below the tab mounting aperture 21 for propagating a tear across the tab 20 for detaching the tab 20 from the bag 11 while retaining sufficient strength in the tab 20 to prevent premature tearing off of the tab 20. This means for propagating a tear includes a neck portion 33 in the detachable tab 20 which is narrower than the remaining portion of the tab 20 and which connects the tab 20 to the respective bag wall layer 13, 14, 15, and a slit 34 extending across a portion of the dimension of the neck portion 34 of the tab 20.

With the above arrangement, when the leading bag 11 of the pack 10 is pulled by a user for removal from the rack R, it will disengage from the pack 10 by breaking of the frangible bond 25, while (before disengagement) pulling the succeeding bag 11 in the pack 10 to cause detaching of the two leading tabs 20 for self opening of the succeeding bag 11 (see FIGS. 7(A)–(C), 8(A)–(D) and 11). This relationship is possible because a predetermined strength of the frangible bond 25, as discussed above, (1) is greater than the predetermined detaching strength of the two leading tabs 20 and (2) is weaker than the predetermined detaching strength of the remaining six tabs 20. This relationship prevents "chaining" of the bags 11 and provides detachment of each successive bag 11 when pulled from the rack R and from the pack 10 and allows self opening of the next bag 11 by detaching the leading two tabs 20 of the successive bag 11.

In order to aid in maintaining the bags 11 in a pack 10 during handling and loading on a rack R, the embodiment of FIGS. 1–8 may preferably includes at least one cold weld area 36 and preferably two cold weld areas 36 extending transversely through the bag pack. These cold weld areas 36 (since each detachable tab 20 in the embodiment of FIGS. 1–8 is detachable from the rack) may be advantageously positioned in the tab portion 20 on either side of the mounting aperture 21. The embodiment of FIGS. 9–11 may also include means for maintaining the bags 11 in the pack 10 in substantial registration during handling and mounting on the rack R by providing a heat seal compression bond 38 through the superimposed mounting tabs 10 and through the flap formed by the inverted U-shaped slit forming the mounting aperture 21 (see FIG. 9).

Due to the increased thickness of the pack 10 of bags 11 of the star seal type for the same number of bags, it may be preferable that the aperture 21 in the mounting tab of each bag comprise a clean-cut area without any flap for ease of loading onto a rack. However, as shown in the embodiment of FIGS. 9–11, this aperture 21 may comprise a inverted U-shaped cut defining a flap portion in the aperture. This shape aperture 21 for the embodiment of FIGS. 9–11 maintains the detachable tab 20 on the rack R when detached from the bag 11.

Either embodiment of bags 11 of the pack 10 may be constructed of any suitable plastic material. However, it has been found preferable to form the bags primarily of a high molecular weight, high density polyethylene material to provide the desired strength to the bag. More preferably, the bags 11 may comprise a co-extrusion of primarily high molecular weight, high density polyethylene for providing a desired strength to the bag 11 and low density polyethylene or linear low density polyethylene for enhancing the corona-induced pressure bond. Blended material and additional extruded layers may be included.

This invention has been described in considerable detail with reference to the preferred embodiments. However, it will be apparent that variations and modifications can be made within the spirit and scope of the invention as described in the foregoing detailed specification and as defined in the following claims.

What is claimed is:

1. A pack of self-opening serially-arranged plastic bags particularly suited for use in packaging grocery produce and adapted for being suspended in desired lengths from a rack for being serially self-opened and removed from said rack, each of said bags comprising:

integrally formed front and rear walls and gussetted side walls extending inwardly toward each other to terminate in close proximity to each other, said walls having top portions defining an open mouth, and said front and rear walls and said gussetted side walls being further folded over onto each other along a longitudinal axis of said bag to define eight superimposed wall layers in said bag having a front layer, a rear layer and six intermediate layers;

a seal of the star seal type securing the bottoms of said eight superimposed wall layers together to close the bottom of said bag;

mounting tabs forming a part of said top portion of each of said eight wall layers portion and being in superimposed positions and each including an aperture adapted for mounting said tabs on a tab retaining device of the rack in a non-front-side-free manner, each of said tabs including means rendering said tab detachable and providing a predetermined detaching strength; and a frangible bond between said rear layer and said front layer of each successive bag in said pack, said bond having a predetermined strength (1)which is greater than said predetermined detaching strength of two of said tabs and (2) which is weaker than the predetermined detaching strength of the remaining six tabs to allow a leading bag of said pack, when pulled by a user for removal, to disengage from said pack, while before disengagement pulling a succeeding bag in the pack to cause detaching of the two leading of said tabs for self-opening of said succeeding bag.

2. A pack of self-opening serially-arranged plastic bags, as set forth in claim 1 in which said frangible bond between successive bags comprises a corona treatment on said front and rear layers of each of said bags; and at least one localized compressed area extending transversely through said bag pack in said top portions of said bags such that said pack has a decreased thickness in said at least one compressed area and wherein adjacent corona treated front and rear layers of successive bags in said at least one compressed area are adhered together by a corona-induced pressure bond and adjacent intermediate layers in said at least one compressed area are not appreciably adhered together.

3. A pack of self-opening serially-arranged plastic bags, as set forth in claim 2, in which there are a plurality of compressed areas in each bag positioned in said top portions of said bag walls and below said apertures in said mounting tabs.

4. A pack of self-opening serially-arranged plastic bags, as set forth in claim 1, 2 or 3, in which said means rendering each of said tabs detachable and providing a predetermined detaching strength comprises means for propagating a tear from said tab mounting aperture to a top of said tab for detaching said tab from the tab retaining device of the rack while retaining sufficient strength in the portion of said tab above said tab mounting aperture to prevent premature tearing of said tab.

5. A pack of self-opening serially-arranged plastic bags, as set forth in claim 4, in which said means for propagating a tear from said tab mounting aperture to the top of said tab comprises a V-shaped cut-out in the top of said tab over said tab mounting aperture and a nick formed in said tab and extending from said V-shaped cut-out toward said tab mounting aperture.

6. A pack of self-opening serially-arranged plastic bags, as set forth in claim 4, further including at least one cold weld area piercing and extending transversely through said pack for aiding in maintaining said bags in said pack in substantial registration.

7. A pack of self-opening serially-arranged plastic bags, as set forth in claim 4, in which said aperture in said mounting tab of each bag comprises a clear-cut hole without any flap for ease of loading onto a rack.

8. A pack of self-opening serially-arranged plastic bags, as set forth in claim 1, 2 or 3, in which said mounting tabs extend upwardly from tops of each of said eight wall layers, and said means rendering each of said tabs detachable and providing a predetermined detaching strength comprises means positioned below said tab mounting aperture for propagating a tear across said tab for detaching said tab from said bag while retaining sufficient strength in said tab to prevent premature tearing off of said tab.

9. A pack of self-opening serially-arranged plastic bags, as set forth in claim 8, in which said means for propagating a tear across said tab comprises a neck portion in said tab which is narrower than the remaining portion of said tab and which connects said tab to said respective bag wall layer, and a slit extending across a portion of the dimension of said neck portion of said tab.

10. A pack of self-opening serially-arranged plastic bags, as set forth in claim 8, further including a heat seal compression bond through the superimposed mounting tabs for aiding in maintaining said bags in said pack in substantial registration.

11. A pack of self-opening serially-arranged plastic bags, as set forth in claim 8, in which said aperture in said mounting tab of each bag comprises a generally inverted U-shape cut defining a flap portion.

12. A pack of self-opening serially-arranged plastic bags particularly suited for use in packaging grocery produce and adapted for being suspended in desired lengths from a rack for being serially self-opened and removed from said rack, each of said bags comprising: integrally formed front and rear walls and gussetted side walls extending inwardly toward each other to terminate in close proximity to each other, said walls having top portions defining an open mouth, and said front and rear walls and said gussetted side walls being further folded-over onto each other along a longitudinal axis of said bag to define eight superimposed wall layers in said bag having a front layer, a rear layer and six intermediate layers;

a seal of the star-seal type securing the bottoms of said eight superimposed wall layers together to close the bottom of said bag;

mounting tabs extending upwardly from each of said eight wall layers at said top portion and being in superimposed positions and each including an aperture adapted for mounting said tabs on a tab retaining device of the rack in a non-front-side-free manner;

each of said tabs including means rendering said tab detachable and providing a predetermined detaching strength, said means comprising a V-shaped cut-out in the top of said tab over said tab mounting aperture and a nick formed in said tab and extending from said V-shaped cut-out toward said tab aperture for propagating a tear from said tab mounting aperture to a top of said tab for detaching said tab from said tab retaining device of the rack while retaining sufficient strength in the portion of said tab above said tab mounting aperture to prevent premature tearing of said tab and provide a predetermined detaching strength to said tab;

said aperture in each of said mounting tabs comprising a clear-cut hole without any flap for ease of loading onto a rack;

at least one cold weld area piercing and extending transversely through said bag pack for aiding in maintaining said bags in said pack in substantial registration;

a frangible bond between said rear layer and said front layer of each successive bag in said pack, said bond having a predetermined strength which is greater than said predetermined strength of two of said tabs and which is weaker than the detaching strength of the remaining six tabs to allow a leading bag of said pack when pulled by a user for removal to disengage from said pack, while before disengagement pulling a succeeding bag in the pack to cause detaching of the two leading of said tabs for self-opening of said succeeding bag; and said frangible bond between said successive bags comprising a corona treatment on said front and rear layers of each of said folded bags, and a plurality of compressed areas in each bag positioned in said top portions of said bag walls and below said apertures in said mounting tabs and extending transversely through said bag pack such that said pack has a decreased thickness in said compression areas and wherein adjacent corona treated front and rear layers of successive bags in said compressed areas are adhered together by a corona-induced pressure bond and adjacent intermediate layers in each of said compressed areas are not appreciably adhered together.

13. A pack of self-opening serially-arranged plastic bags particularly suited for use in packaging grocery produce and adapted for being suspended in desired lengths from a rack for being serially self-opened and removed from said rack, each of said bags comprising:

integrally formed front and rear walls and gussetted side walls extending inwardly toward each other to terminate in close proximity to each other, said walls having top portions defining an open mouth, and said front and rear walls and said gussetted side walls being further folded-over onto each other along a longitudinal axis of said bag to define eight superimposed wall layers in said bag having a front layer, a rear layer and six intermediate layers;

a seal of the star-seal type securing the bottoms of said eight superimposed wall layers together to close the bottom of said bag;

mounting tabs extending upwardly from each of said eight wall layers at said top portion and being in superimposed positions and each including an aperture adapted for mounting said tabs on a tab retaining device of the rack in a non-front-side-free manner;

each of said tabs including means rendering said tab detachable and providing a predetermined detaching strength, said means comprising a neck portion in each of said tabs which is narrower than the remaining portion of said tab and which connects said tab to said respective bag wall layer and a slit extending across a portion of the dimension of said neck portion of said tab for propagating a tear across said tab for detaching said tab from said bag while retaining sufficient strength in said tab to prevent premature tearing off of said tab and for providing a predetermined detaching strength to said tab;

a heat seal compressed bond area extending through said superimposed mounting tabs for aiding in maintaining said bags in said pack in substantial registration;

a frangible bond between said rear layer and said front layer of each successive bag in said pack, said bond having a predetermined strength which is greater than said predetermined strength of two of said tabs and which is weaker than the detaching strength of the remaining six tabs to allow a leading bag of said pack when pulled by a user for removal to disengage from said pack, while before disengagement pulling a succeeding bag in the pack to cause detaching of the two leading of said tabs for self-opening of said succeeding bag; and said frangible bond between said successive bags comprising a corona treatment on said front and rear layers of each of said folded bags, and a plurality of compressed areas in each bag positioned in said top portions of said bag walls and below said neck portion in said mounting tabs and extending transversely through said bag pack such that said pack has a decreased thickness in said compression areas and wherein adjacent corona treated front and rear layers of successive bags in said compressed areas are adhered together by a corona-induced pressure bond and adjacent intermediate layers in each of said compressed areas are not appreciably adhered together.

14. A pack of self-opening serially-arranged plastic bags, as set forth in claims 1, 2, 3, 12 or 13, in which said bags of said pack are formed primarily of high molecular weight, high density polyethylene material to provide the desired strength to said bag.

15. A pack of self-opening serially-arranged plastic bags as set forth in claims 2, 3, 12 or 13, in which each of said bags comprises a co-extrusion of primarily high molecular weight, high density polyethylene for providing a desired strength to the bag and low density polyethylene or linear low density polyethylene for enhancing the corona-induced pressure bond.

* * * * *